US005206693A

United States Patent [19]

Folkins

[11] Patent Number: 5,206,693

[45] Date of Patent: Apr. 27, 1993

[54] DEVELOPMENT UNIT HAVING AN ASYMMETRICALLY BIASED ELECTRODE WIRES

[75] Inventor: Jeffrey J. Folkins, Rochester, N.Y.

[73] Assignee: Xerox Corporation, Stamford, Conn.

[21] Appl. No.: 745,786

[22] Filed: Aug. 16, 1991

[51] Int. Cl.[5] ..... G03G 15/06

[52] U.S. Cl. ..... 355/261; 118/647; 118/654; 355/246; 355/247

[58] Field of Search ..... 355/245, 246, 247, 251, 355/259, 261, 265; 118/651, 654, 638, 647, 648

[56] References Cited

U.S. PATENT DOCUMENTS

| | | | |
|---|---|---|---|
| 4,102,305 | 6/1978 | Schwarz | 118/651 |
| 4,565,438 | 1/1986 | Folkins | 355/251 |
| 4,792,831 | 12/1988 | Takeda et al. | 355/251 X |
| 4,868,600 | 9/1989 | Hays et al. | 355/259 |
| 4,887,102 | 12/1989 | Yoshikawa et al. | 355/246 X |
| 4,913,348 | 4/1990 | Hays | 355/246 X. |

FOREIGN PATENT DOCUMENTS 3-111855 5/1991 Japan .

*Primary Examiner*—R. L. Moses
*Assistant Examiner*—Shuk Y. Lee
*Attorney, Agent, or Firm*—H. Fleischer; J. E. Beck; R. Zibelli

[57] ABSTRACT

The present invention is an apparatus that develops a latent image recorded on a surface with toner. An electrically biased electrode member in the development zone between the photoconductive member and the donor roll detaches toners from the donor roll so as to form a toner powder cloud in the development zone. The electrical bias applied on the electrode member is an asymmetrical wave. Toner from the toner powder cloud develops the latent image.

4 Claims, 4 Drawing Sheets

DEVELOPMENT UNIT HAVING AN ASYMMETRICALLY BIASED ELECTRODE WIRES

BACKGROUND OF THE INVENTION

This invention relates generally to the development of electrostatic images, and more particularly concerns a scavengeless development system in which an asymmetrical electrical bias is applied on the electrode wires.

The invention can be used in the art of electrophotographic printing. Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system, a magnetic developer roll attracts developer from a reservoir. The developer includes carrier and toner. The toner is attracted from the carrier to a donor roll. The donor roll then carries the toner into proximity with the latent image.

A problem with the scavengeless development system is that of wire movement, referred to as strobing. Wire strobing occurs when the interaction between the scavengeless wires, wire AC voltage, donor roll and toner materials creates a condition wherein the wires physically oscillate causing a quality defect in the developed image.

The following disclosures may be relevant to various aspects of the present invention:

U.S. Pat. No. 4,102,305. Patentee: Schwarz. Issued: Jul. 25, 1978.

U.S. Pat. No. 4,565,438. Patentee: Folkins. Issued: Jan. 21, 1986.

U.S. Pat. No. 4,868,600. Patentee: Hays et al. Issued: Sep. 19,1989.

Co-pending U.S. patent application Ser. No. 07/563,026. Applicant: Floyd Jr. et al. Filed: Aug. 3, 1990.

The relevant portions of the foregoing disclosures may be briefly summarized as follows:

U.S. Pat. No. 4,102,305 describes a developer roll that is electrically biased with an AC voltage superimposed over a DC voltage.

U.S. Pat. No. 4,565,438 discloses an asymmetrical alternating electrical bias applied on a developer roller.

U.S. Pat. No. 4,868,600 describes a scavengeless development system in which toner is detached from a donor roll and a powder cloud obtained by AC electrically biased electrode wires. The donor roll is electrically biased by a DC voltage.

Co-pending U.S. patent application Ser. No. 07/563,026 describes a magnetic roll for transporting developer material from a reservoir to a donor roll and electrode wires that are electrically biased to detach toner from the donor roll so as to form a toner cloud in the development zone.

BRIEF SUMMARY OF THE INVENTION

In accordance with one aspect of the present invention, there is provided an apparatus for developing a latent image recorded on a surface with toner. The apparatus includes means for transporting toner to a development zone adjacent the surface. An electrode member is disposed in the development zone. Means are provided for electrically biasing the electrode member with an asymmetric electrical field to detach toner from the transporting means and produce a toner cloud in the development zone.

Pursuant to another aspect of the present invention, there is provided an electrophotographic printing machine for developing a latent image recorded on a photoconductive surface with toner. The printing machine includes a means for transporting toner to a development zone adjacent the surface. An electrode member is disposed in the development zone. Means are provided for electrically biasing the electrode member with an asymmetric electrical field to detach toner from the transporting means and produce a toner cloud in the development zone.

Other features of the present invention will become apparent as the following description proceeds and upon reference to the drawings.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
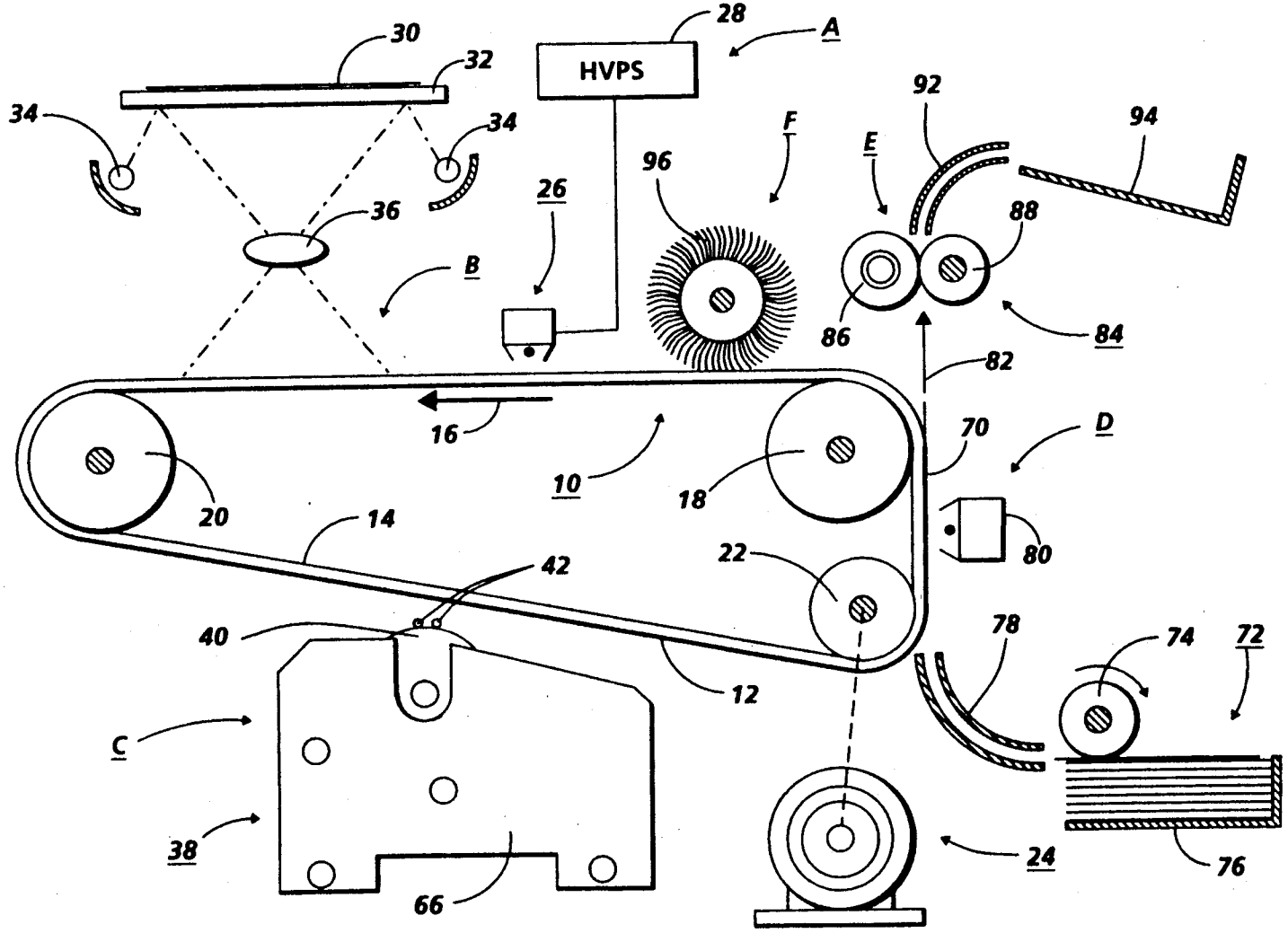
FIG. 1 is a schematic elevational view of an illustrative electrophotographic printing machine incorporating a developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed of throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber in developer housing 66 stores a supply of developer material. In one embodiment the developer material is a single component development material of toner particles, whereas in another the developer material includes at least toner and carrier. Various embodiments of developer unit 38 will be discussed hereinafter, in greater detail, with reference to FIGS. 2 and 3.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
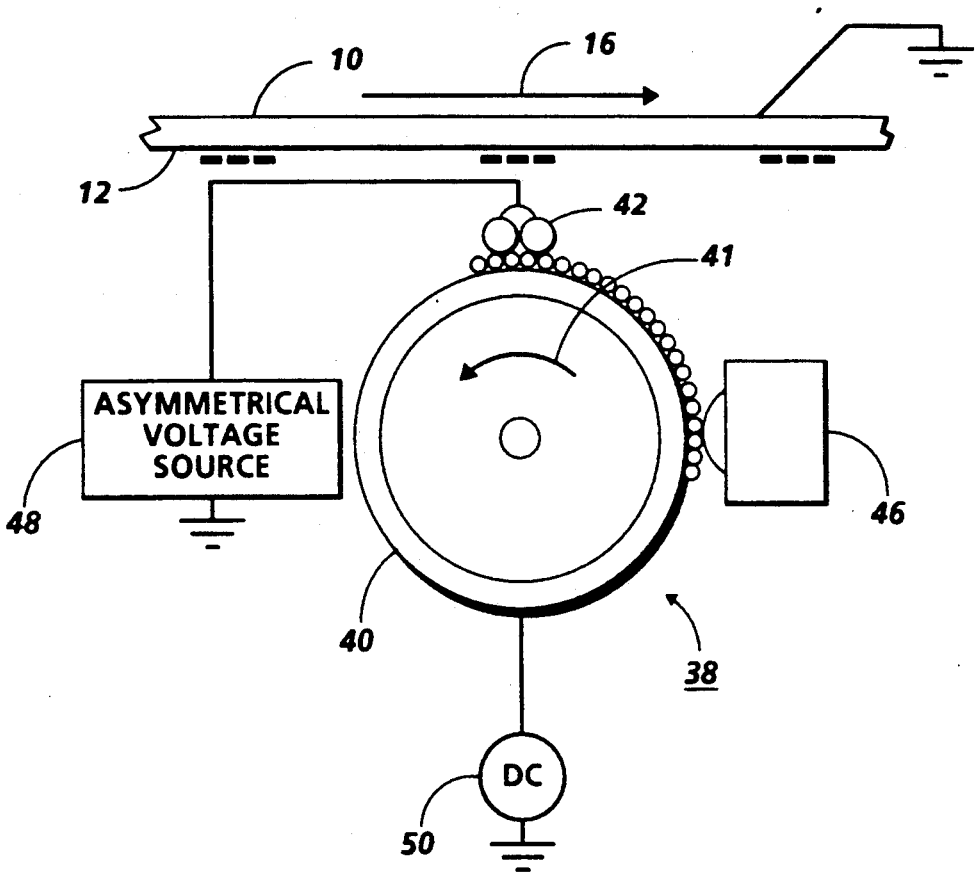
FIG. 2 is a schematic elevational view showing one embodiment of the developer unit used in the FIG. 1 printing machine.

Referring now to FIG. 2, there is shown one embodiment of the present invention in greater detail. The development system 38 includes a donor roll 40, electrode wires 42, and metering and charging roll 46. The donor roll 40 attracts toner from the reservoir and roll 46 charges the toner and meters the quantity on the donor roll. The donor roll 40 can be rotated in either the 'with' or 'against' direction relative to the direction of motion of belt 10. The donor roll is shown rotating in the direction of arrow 41. The metering and charging roll 46 may comprise any suitable device for metering and charging the toner. For example, it may comprise an apparatus such as described in U.S. Pat. No. 4,459,009 wherein the contact between weakly charged toner particles and a triboelectrically active coating contained on a charging roll results in well charged toner. Other combination metering and charging devices may also be employed.

The developer apparatus 38 further has electrode wires 42 located in the space between photoconductive surface 12 and donor roll 40, as described in U.S. Pat. No. 4,868,600. The electrode wires 42 include one or more thin tungsten wires which are lightly positioned against the donor roll 40. The distance between the wires 42 and the donor roll 40 is approximately the thickness of the toner layer on the donor roll 40. The extremities of the wires are supported by the tops of end bearing blocks (not shown) which also support the donor roll 40 for rotation.

An asymmetrical electrical bias is applied to the electrode wires by an asymmetrical voltage source 48. The critical aspect of the voltage source is its asymmetry, so whether the underlying waveform to be skewed is a square wave or a sine wave is not important. The bias establishes an asymmetric electrostatic field between the wires 42 and the donor roll 40 which is effective in detaching toner from the surface of the donor roll 40 and forming a toner cloud about the wires 42, the height of the cloud being such as not to contact with the photoconductive surface 12. The bias 48 is asymmetrical for the purpose of reducing oscillation of the electrode wires. Without the asymmetry, wire strobing is a problem. Various aspects of the asymmetry will be discussed hereinafter, in greater detail, with reference to FIG. 4. While the bias is illustrated as being applied to the electrode wires 42, it could equally as well be applied to the donor roll 40.

A DC bias supply 50 establishes an electrostatic field between the photoconductive surface 12 and the donor roll 40 for attracting the detached toner particles from the cloud surrounding the wires 42 to the latent image on the photoconductive surface 12. In addition to using the above-described asymmetric voltage source, another way to reduce oscillation is to shift the DC component of the wire from the normally used donor roll voltage and toward a value which corresponds to the voltage on top of the donor roll's toner layer.

Figure 3:
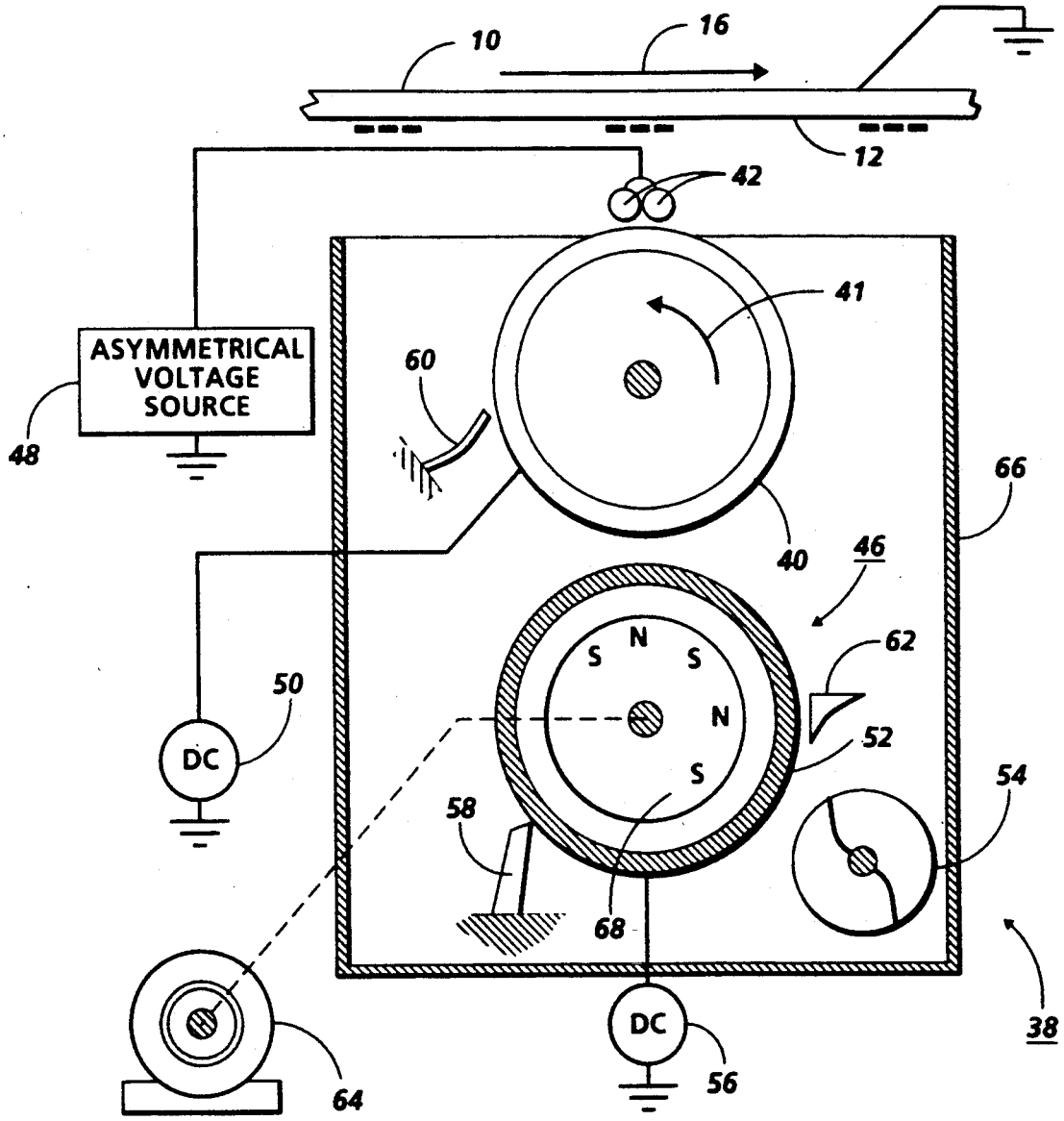
FIG. 3 is a schematic elevational view showing another embodiment of the developer unit used in the FIG. 1 printing machine.

Referring now to FIG. 3, there is shown another embodiment of the present invention in greater detail. The development system 38 includes a donor roll 40, electrode wires 42, and magnetic roll 46. The donor roll 40 conveys developer material comprising at least carrier and toner deposited thereon by the magnetic roll 46. The donor roll 40 can be rotated in either the 'with' or 'against' direction relative to the direction of motion of belt 10. The donor roll is shown rotating in the direction of arrow 41.

The developer apparatus 38 has electrode wires 42 located in the space between photoconductive surface 12 and donor roll 40. The electrode wires 42 include one or more thin tungsten wires which are lightly positioned against the donor roll 40. The distance between the wires 42 and the donor roll 40 is approximately the thickness of the toner layer on the donor roll 40. The extremities of the wires are supported by the tops of end bearing blocks (not shown) which also support the donor roll 40 for rotation.

An asymmetrical electrical bias is applied to the electrode wires by an asymmetrical voltage source 48. The critical aspect of the voltage source is its asymmetry, so whether the underlying waveform to be skewed is a square wave or a sine wave is not important. The bias establishes an asymmetric electrostatic field between the wires 42 and the donor roll 40 which is effective in detaching toner from the surface of the donor roll 40 and forming a toner cloud about the wires 42, the height of the cloud being such as not to contact with the photoconductive surface 12. The bias 48 is asymmetrical for the purpose of reducing oscillation of the electrode wires. Without the asymmetry, wire strobing is a problem. Various aspects of the asymmetry will be discussed hereinafter, in greater detail, with reference to FIG. 4. While the bias is illustrated as being applied to the electrode wires 42, it could equally as well be applied to the donor roll 40.

A DC bias supply 50 establishes an electrostatic field between the photoconductive surface 12 and the donor roll 40 for attracting the detached toner particles from the cloud surrounding the wires 42 to the latent image on the photoconductive surface 12. In addition to using the above-described asymmetric voltage source, another way to reduce oscillation is to shift the DC component of the wire from the normally used donor roll voltage and toward a value which corresponds to the voltage on top of the donor roll's toner layer. In a two component loaded system this voltage corresponds closely to the magnetic roll bias voltage.

Before the transfer of toner from the magnetic roll 46 to the donor roll 40, a cleaning blade 60 strips all of the toner from donor roll 40 so that magnetic roll 46 meters fresh toner to a clean donor roll. Then a DC bias supply 56 establishes an electrostatic field between magnetic roll 46 and donor roll 40 which causes toner particles to be attracted from the magnetic roll to the donor roll. Metering blade 62 is positioned closely adjacent to magnetic roll 46 to maintain the compressed pile height of the developer material on magnetic roll 46 at the desired level.

Magnetic roll 46 includes a non-magnetic tubular member or sleeve 52 made preferably from aluminum and having the exterior circumferential surface thereof roughened. An elongated multiple magnet 68 is positioned interiorly of and spaced from the tubular member. Elongated magnet 68 is mounted on bearings and coupled to motor 64. Tubular member 52 may also be mounted on suitable bearings and coupled to motor 64. Toner particles are attracted from the carrier granules on the magnetic roll to the donor roll. Scraper blade 58 removes denuded carrier granules and extraneous developer material from the surface of tubular member 52.

As successive electrostatic latent images are developed, the toner particles within the developer material are depleted. Augers 54 are mounted rotatably to mix fresh toner particles with the remaining developer material so that the resultant developer material therein is substantially uniform with the concentration of toner particles being optimized, as described in Co-pending U.S. patent application Ser. No. 07/563,026.

Figure 4:
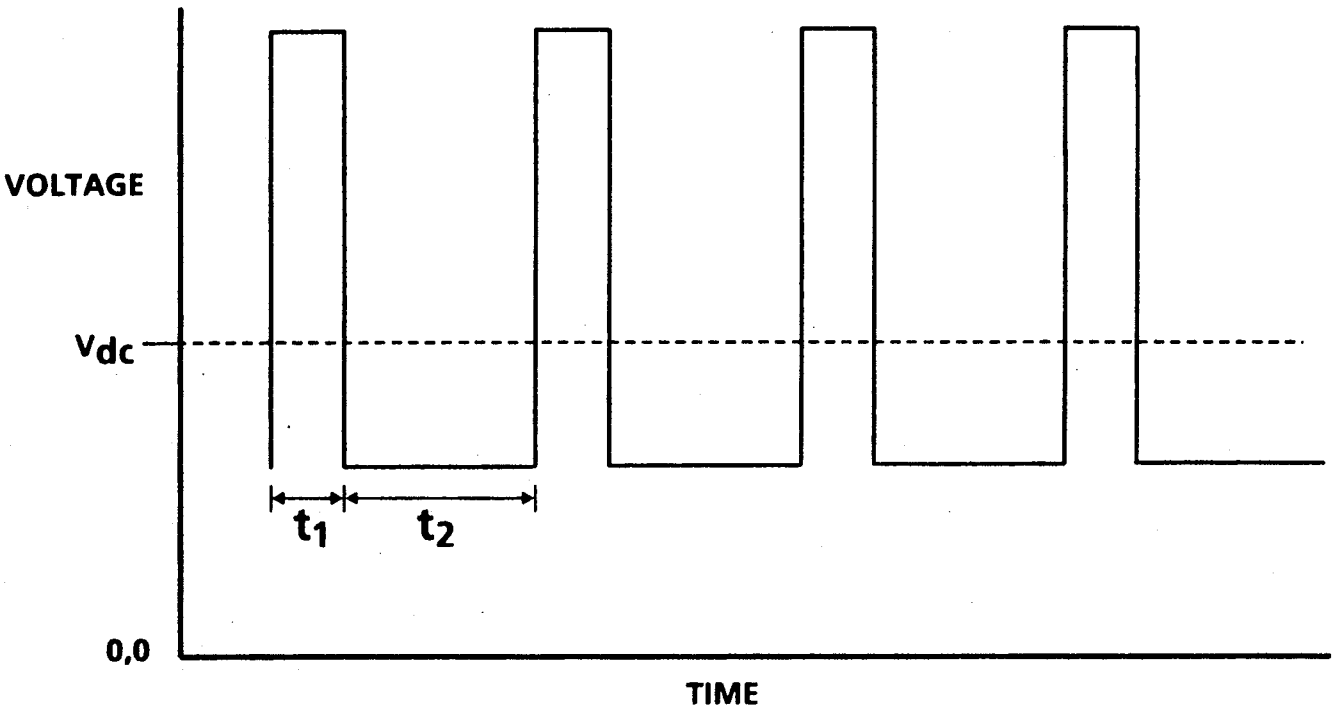
FIG. 4 is a graph of an exemplary asymmetric electrical waveform electrically biasing the electrode wires of the FIG. 2 and FIG. 3 developer units.

Referring now to FIG. 4, there is shown a graph of an exemplary asymmetric electrical waveform electrically biasing the electrode wires of the FIG. 2 and FIG. 3 developer units. It has been found experimentally that inducing a 20/80% duty cycle between $t_1$ and $t_2$ can reduce the forces of friction between the electrode member wires and the donor roll by typically ten times and that some strobing disappears at asymmetries as little as 40/60%. Although skewing the electrical waveform can result in reduced developability, such a reduction can be counteracted by increasing the asymmetric voltage amplitude. The direction of the asymmetry is important to the scavengeless developability because the toner is of a specific polarity and is pushed in different directions by different polarities of electric fields. Hence the direction of asymmetry is important in a real system and is dependent on the toner polarity, as well as other operating parameters.

In recapitulation, it is evident that the development system of the present invention includes electrode wires positioned closely adjacent the exterior surface of a donor roll and in the gap defining the development zone between the donor roll and the photoconductive belt. After the toner particles are positioned on the donor roll, an asymmetrical electrical bias is applied to the electrode wires via an asymmetrical voltage source superimposed by a DC voltage source for the purposes of detaching toner from the donor roll and attracting toner to the photoconductive belt.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type in which an electrostatic latent image recorded on a charge retentive surface is developed with toner to form a visible image thereof, wherein the improvement includes:

a donor roll arranged to transport toner to a development zone adjacent the surface;

a plurality of electrode wires disposed in the development zone; and means for electrically biasing said electrode wires relative to said donor roll with a DC electric potential and an asymmetrical AC electrical wave form to detach toner from said donor roll and produce a toner cloud in the development zone.

2. A printing machine according to claim 1, wherein said electrical biasing means electrically biases said electrode wires relative to said donor roll with a DC electrical potential and an asymmetrical AC electrical waveform.

3. A printing machine according to claim 2, wherein the asymmetrical AC electrical waveform is an asymmetrical square wave.

4. A printing machine according to claim 2, further including, a magnetic roll; and means for electrically biasing said magnetic roll with at least a DC electrical potential having a magnitude approximately equal to the magnitude of the DC electrical potential electrically biasing said electrode wires.

* * * * *